US005157373A

United States Patent [19]

Bertram et al.

[11] Patent Number: 5,157,373

[45] Date of Patent: Oct. 20, 1992

[54] POST GLOVER RESISTOR

[75] Inventors: John R. Bertram, Ft. Thomas; David W. Allen, Florence, both of Ky.

[73] Assignee: Post Glover Resistors, Inc., Erlanger, Ky.

[21] Appl. No.: 667,108

[22] Filed: Mar. 8, 1991

[51] Int. Cl.[5] ..... H01C 10/19; H01C 3/10

[52] U.S. Cl. ..... 338/319; 338/279; 338/281; 338/58

[58] Field of Search ..... 338/319, 279, 280, 281, 338/283, 284, 58

[56] References Cited

U.S. PATENT DOCUMENTS

| | | | |
|---|---|---|---|
| 1,184,706 | 5/1916 | Keller . | |
| 2,740,033 | 3/1956 | Perrine et al. | 338/281 X |
| 2,969,516 | 1/1961 | Du Bois | 338/284 |
| 3,212,045 | 10/1965 | Weyenberg | 338/316 |
| 3,550,058 | 12/1970 | Du Bois, Jr. | 338/57 |
| 4,100,526 | 7/1978 | Kirilloff et al. | 338/279 |
| 4,654,627 | 3/1987 | Harkness | 338/319 |

FOREIGN PATENT DOCUMENTS

| | | | |
|---|---|---|---|
| 535157 | 3/1941 | United Kingdom | 338/279 |

*Primary Examiner*—Marvin M. Lateef

[57] ABSTRACT

A high power resistor grid assembly formed of a plurality of stainless steel resistor U-shaped elements arranged in a substantially parallel relationship welded together in a continuous path. Each element comprising a slotted rectangular sheet in a U-shape having elongated curved embossments to prevent warpage of the element upon heating. Each U-shaped element has alternately a right and left leg offset to permit end to end attachments of elements while maintaining uniform spacing between the elements. The elements are supported by pairs of double insulated members which are affixed to the top and bottom of a frame with a floating end to permit expansion of the assembly upon heating and contraction upon cooling.

7 Claims, 5 Drawing Sheets

POST GLOVER RESISTOR

BACKGROUND OF THE INVENTION

1. Field of the Invention

This invention relates to resistor structures in general and more particularly to a novel and improved resistor grid assembly and resistor grid element capable of extremely high wattages for its size.

2. Description of the Prior Art

The present invention relates to resistor structures and in particular to elements of the resistor structure which allow the resistor to maintain extremely high wattages.

There are essentially three types of resistors available today in the industry. The low current resistor carries a nine to 100 amp current. This type of resistor controls smaller AC/DC motors.

The intermediate resistor can handle a current of 100 to 200 amps and is suitable for somewhat larger motors. Higher horsepower motors as employed in mass transmit cars need high current resistors which can carry currents of 200 amps or more and which are rates at 750–900 volts.

High capacity resistors carry currents of over 200 amps. Most high capacity resistors available today are rated at 600 volts without standoff insulators. The present invention described herein is rates at 1000 volts without standoff insulators.

In the past, some high current resistors have been designed by combining numerous intermediate resistors. This results in the obvious disadvantage of a larger size requiring more space and support for the heavier weight. In addition, multiple current paths increase the possibility of overloads and failure. Maintaining a single current path reduces the potential for overloads and failures.

High capacity resistor grids have typically been arranged in the form of a series of parallel metal grid elements affixed to and positioned between insulating members. When high current values are shunted into the resistor grids, temperatures elevate to such a point that warpage or melting could occur if the grids are not effectively cooled. Therefore, it is necessary to maintain air spaces between the grid members so that heat produced in the grids may be readily dissipated by air flowing, forced or otherwise, over the elements. Stress due to repeated expansion and contraction of the heated resistance elements can often cause failure of the elements. It is imperative that the expansion of the elements take place in a controlled manner so that the parallel alignment of the elements remains intact and uniform to avoid failure.

The normal continuous operating temperature for high capacity resistors is 375° C. according to industry standards. For short intervals, the temperature of the resistor can reach higher values due to surges. In order to accommodate the high current and attendant high temperatures, it is desirable to put the maximum amount of resistor material in the smallest space while still permitting maximum air flow and cooling.

A review of the prior art illustrates low current and high current resistors as well as problems associated with high current resistors and attempts to solve such problems. U.S. Pat. No. 1,184,706 issued to Keller illustrates a multi-pass resistor element formed in a grid with provision for serial or parallel combinations. The grid elements are mounted on insulating bushings and the grids may be insulated from each other by means of insulating washers. Weinberg, U.S. Pat. No. 3,212,045, discloses a multi-stage insulating scheme for a grid-type resistor. Dubois, U.S. Pat. No. 2,969,516 illustrates a zigzag resistor grid formed from a single piece of resistance material. The grid mounting clips engage folded outboard ends of the grid for achieving a sliding joint. The grid elements are angled to increase strength. Angling of the ribs can create stress points which makes the element more susceptible to deforming and failure. Dubois, Jr., U.S. Pat. No. 3,550,058 discloses an electrical resistor structure with individual curved resistor elements which creates turbulent air flow over the elements.

Harkness, U.S. Pat. No. 4,654,627 illustrates a resistor grid assembly in which relatively wide slot resistor elements having offset ends are joined together in a series arrangement. Each element has a longitudinal upraised strengthening rib. This rib would be susceptible to deforming and failure upon repeated heating and cooling. An Australian Patent, No. 113,836 issued to Godfrey illustrates a single grid resistor element having a strengthening rib and offset ends. With the exception of the Harkness and Dubois, Sr. patents, all of the above references are not suited for high wattage requirements. None of the resistors disclosed in the references would be rated above 600 volts without standoff insulators.

SUMMARY OF THE INVENTION

It is a primary object of the present invention to provide a novel and improved resistor which carries high currents.

It is further the object of this invention is to provide a resistor capable of providing high current in a relatively small or moderate amount of space.

Yet another object of this invention is to provide a resistor capable of carrying high current and severe overloads without failure.

A further object of this invention is to provide a unique grid assembly which permits expansion of the resistor elements when hot.

An additional object of this invention is to reduce the amount of frame members required for a high capacity resistor.

It is yet another object of this invention to provide structurally strengthened resistor grid elements that do not warp upon heating and contraction and yet permit maximum laminar air flow over all parts of the element.

Yet another object of this invention is to provide a grid resistor assembly which includes support rods doubly insulated from the frame which can withstand extreme voltage without requiring standoff insulators.

A still further object of this invention is to provide a resistor grid assembly wherein all of the terminals end on the same side of the assembly. The present invention comprises a plurality of u-shaped grid resistor elements having embossment and alternating offset legs. The ends of each grid member are welded together to form a continuous electric current path. The grid members are arranged in a substantially parallel relationship to each other. There are openings at both ends of the element for receiving pairs of rods having insulated sleeves. The rods are affixed to frame members by a nut and bolt assembly. The frame is insulated from the grid elements and rods by a coupled fiberglass insulator to prevent arcing from the elements to the frame. Insulating mica washers in conjunction with steel washers and spacers provide uniform spacing between elements and prevent arcing between the elements. A terminal for delivering current is secured to selected elements. Each element consists of a single piece of sheet metal embossed nearly the entire length of the element to prevent warpage.

BRIEF DESCRIPTION OF DRAWINGS

The above and further objects of the present invention will become more readily apparent as the invention is more completely understood from the following detailed description, reference being made to the accompanying drawings wherein like reference numerals represent like parts throughout and wherein.

DESCRIPTION OF PREFERRED EMBODIMENT

Figure 1:
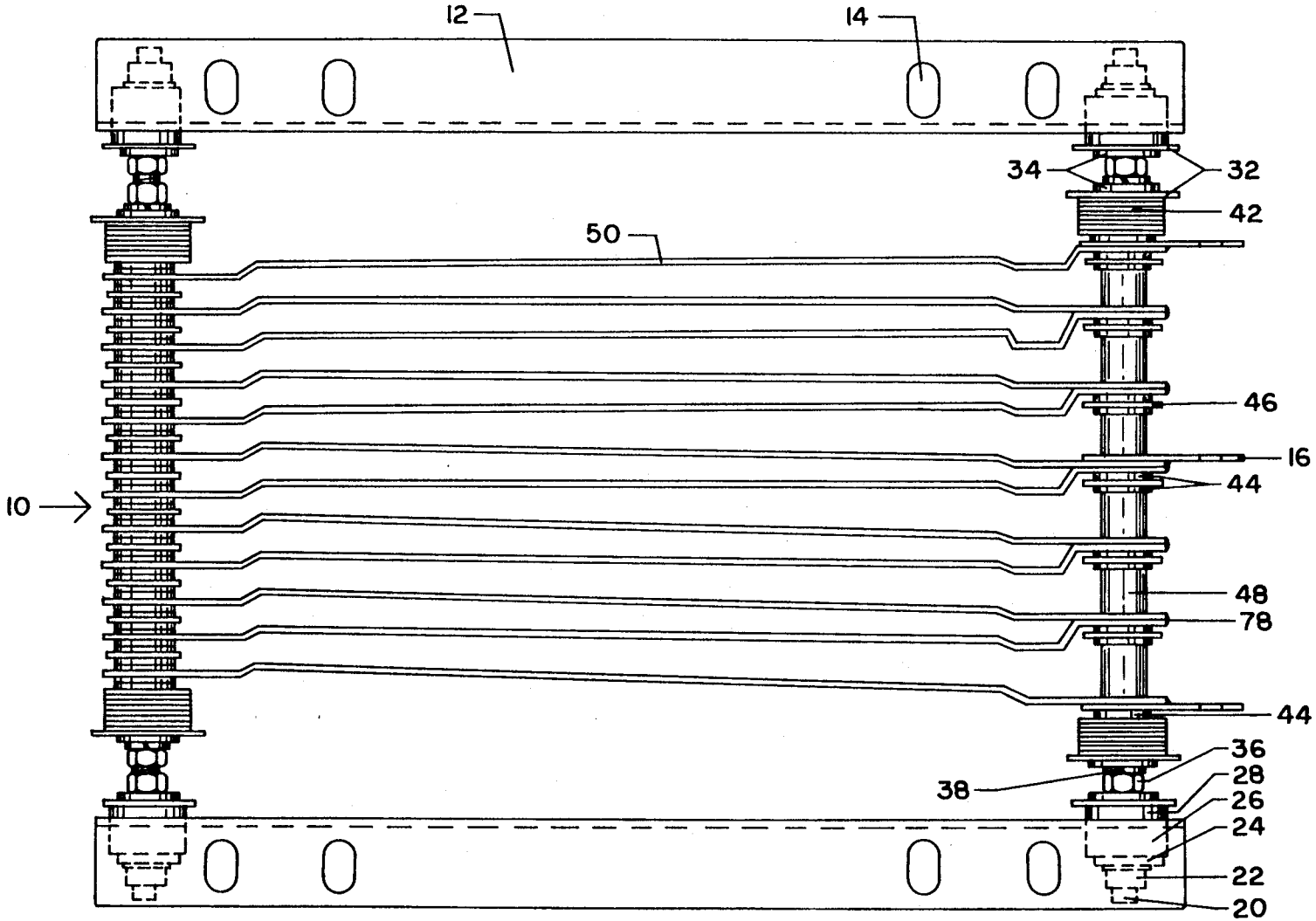
FIG. 1 is an overall top view of the resistor grid assembly of the present invention.

Referring now to FIG. 1, an overall perspective view of the resistor grid assembly, the resistor grid assembly (10) includes end frame members (12) as the major support for the resistor grid assembly. The end frame is generally grounded. The end plates (12) have openings (14) for mounting on a suitable support structure.

Excess current from an electric motor is applied through terminal (16) which is secured to a rod (20) to make contact with the leg of a resistor grid element (50). The electric current is then dissipated as heat through the resistor elements. A pair of threaded rods (20) are mounted on both the top and bottom of the frame.

Figure 2:
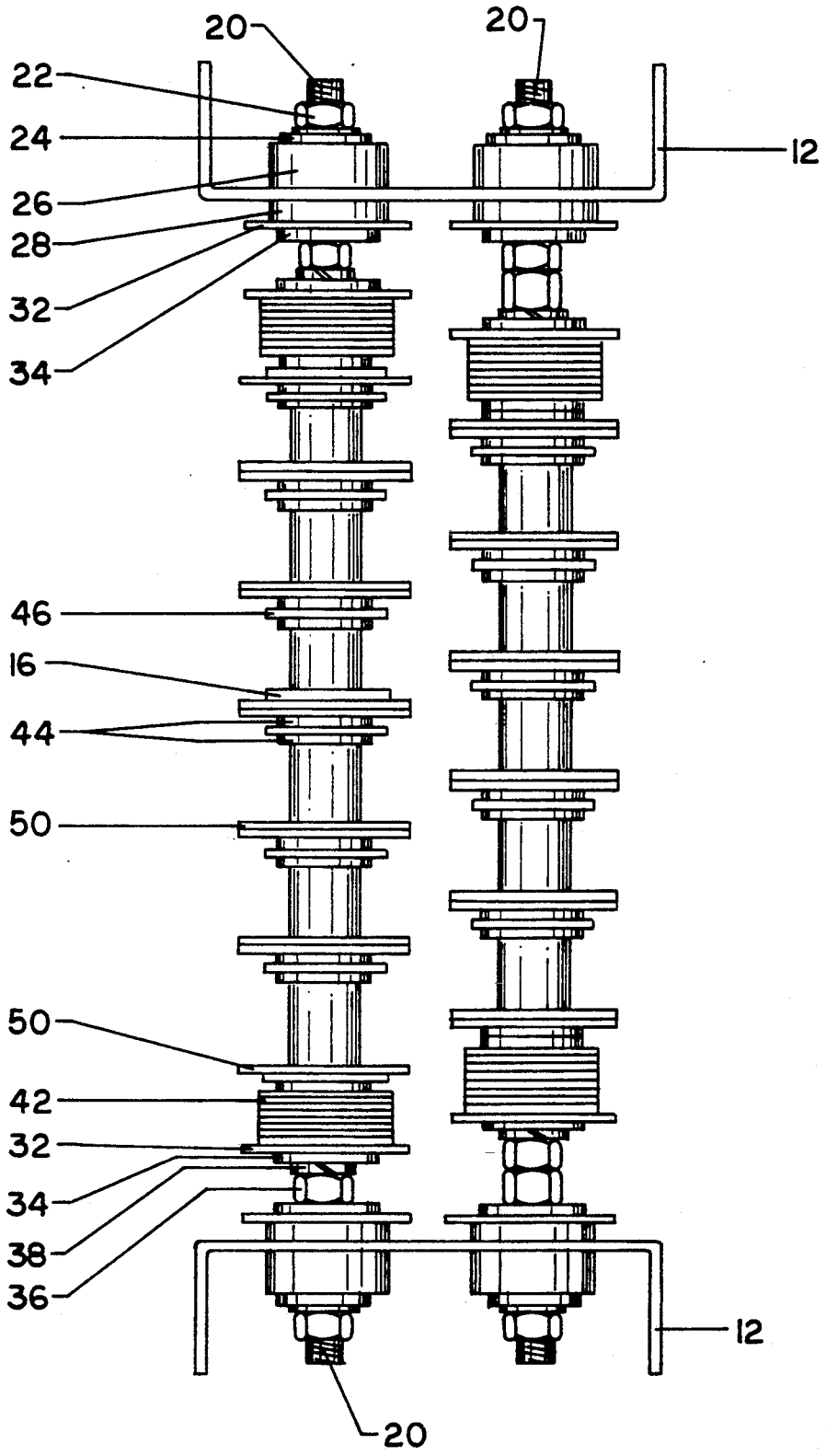
FIG. 2 is a side view of the resistor grid assembly.
Figure 6:
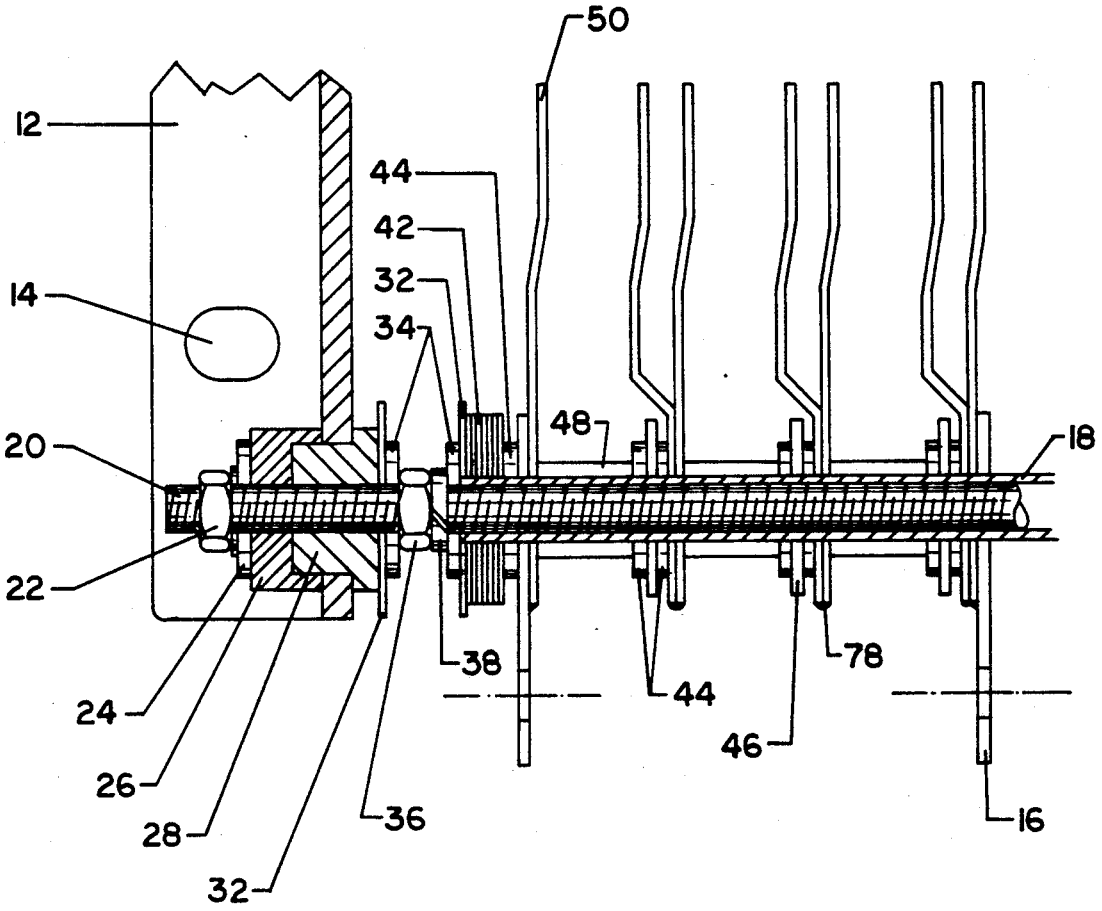
FIG. 6 is a sectional view of the resistor grid assembly showing the insulating members and the mounting of the grid elements thereon.

FIG. 2 illustrates the pair of rods mounted to the frame members. FIG. 6 shows a sectional view of the elements mounted on the rods. The threaded rods (20) are encased in an insulating sleeve (18), usually formed of mica, and are secured to the frame member (12) by an end nut (22) and lock washer (24). When the two bottom rods (20) and two top rods (20) are so affixed to both end frame members (12) a rigid floating frame results. A fiberglass rod insulator (26) is coupled with another fiberglass rod insulator (28) and mounted on the rod around the frame (12) to prevent arcing to the frame (12). Further insulation is provided by a mica insulating washer (32) mounted on the rod next to the fiberglass insulator (28). Adjacent to the mica insulating washer, a steel washer (34) is positioned on the rod. Next to the steel washer (34) is a nut (36) and washer (38) for securing an additional mica insulator (32) and stack of mica washers (42) on the rod. An additional steel washer is provided on the rod and against the stack of mica washers (42). A terminal (16) is mounted on the rod against a steel washer and against a resistor grid element (50).

Positioned adjacent to the resistor element (50) is a pair of steel washers with a mica washer (46) located between the two steel washers. Next to the mica-steel washer assembly is a steel tube spacer (48) positioned on the rod to maintain uniform spacing between grid elements. This uniform spacing assures adequate air flow between the elements to permit heat dissipation. The mica washer prevents arcing between the elements, but it cannot be positioned next to the spacer or the element. The steel washer positioned between the mica and the spacer is necessary to prevent the spacer from crushing the mica washer. The steel washer positioned between the element and the mica washer is necessary to prevent the mica washer from becoming too hot if it were in contact with the element.

Figure 3:
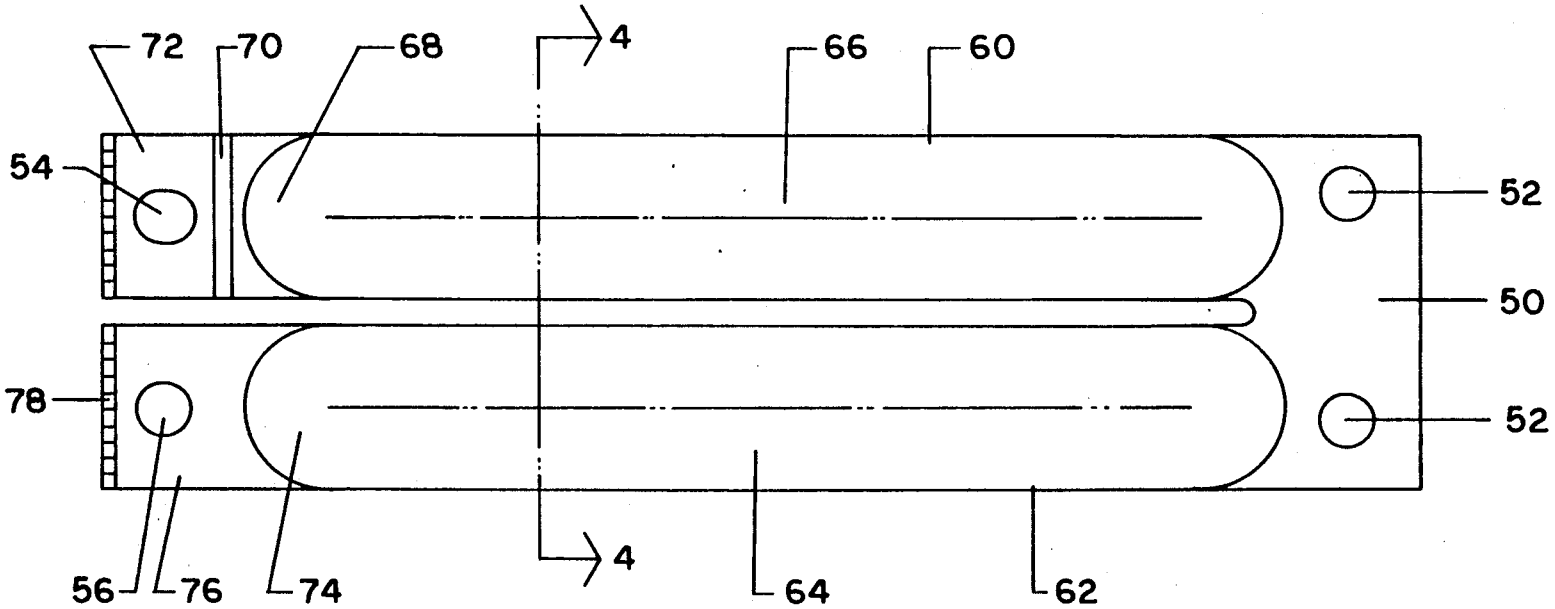
FIG. 3 is a side view of an individual resistor grid element.

Referring now to FIG. 3, a side vie of the resistor element (50), the element (50) is stamped from one piece of sheet metal of an unbreakable alloy and slotted by cutting a u-shaped piece from the metal to create two legs (60 and 62), one of which is offset. Leg (62) is straight and leg (60) is offset from leg (62) to facilitate air flow and permit more effective cooling. Air that has flowed over one leg becomes heated. The offset nature of the legs allows relatively cooler air to pass over each leg and thereby permit greater cooling of the elements.

Each leg has an embossment (66, 64) extending the width of the leg and for the greater part of the length of the leg. It is desirable to extend the embossment longitudinally to preferably 90% of the element or as far as possible on each leg. The length of the embossment is necessarily limited by the requirement to provide tips of the legs for openings to receive rods. On the upper portion of the element (50) which joins the two legs, a pair of openings (52) are provided to receive the threaded rods (20) which are mounted to the top of the frame (12) of the resistor grid assembly (10). The bottom of the elements are provided with openings also. The opening (56) on leg (62), the straight leg, is designed in same fashion as the opening (52) for the same purpose to receive the threaded rod (20) mounted to the frame member (12) of the grid assembly (10). On leg (60), the offset leg, the aperture (54) is elongated to provide a slotted hole to accommodate the rod (20).

Leg (62) includes an embossment (64) which extends the width of the leg and which curves and slants upward (74) to the tip of the leg (76). Leg (60) also includes a similar embossment extending the width of the leg and includes a slanting and curved surfaces (68) at the tip of the leg (72) which includes an offset (70). Individual elements (50) are welded together at the end of the leg (78) to form a continuous current path.

Figure 4:
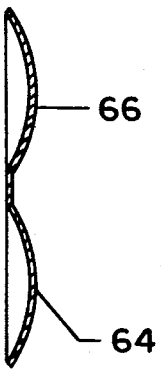
FIG. 4 is a sectional view of the resistor grid element taken across line 4—4 of FIG. 3 illustrating the nature of the embossment of the grid.

FIG. 4 which is a sectional view of the resistor element taken across line 4—4 from FIG. 3 illustrates the embossment (64 and 66) extending the width of each leg.

Figure 5:
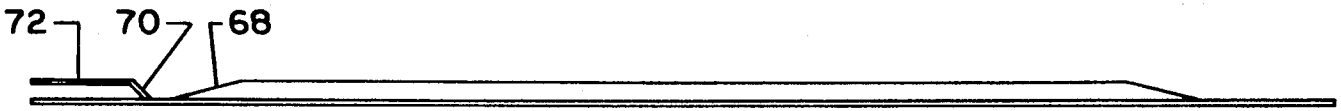
FIG. 5 is a top view of the resistor grid element depicting the offset leg.

FIG. 5 shows a top view of the individual resistor element illustrating the embossment (64, 66) and offset (70). The offset (70) must be deeper and extend further than the embossment (64, 66). The offset (70) must be alternating to permit welding of the elements.

When current is applied through terminal (16) the current runs through the individual resistor elements (50) which are consequently heated to temperatures a high as 600° C. As the metal heats, expansion of the element occurs. Conversely as the metal cools contraction occurs. The embossment employed in the present invention is particularly designed to prevent warpage of the elements upon expansion and contraction. There is an optimal radius for the embossment which is the deepest point the embossment can reach without causing cracks to appear in the metal. FIG. 4 shows that the thickness of the metal remains uniform throughout the embossment. It is also important, for purposes of preventing warpage of the individual element that the embossment of the leg have curved, upwardly slanted sides which then joins the tips or ends of both legs to minimize the stresses on the metal. Any sharp lines or V's in the element can create fatigue points. The embossment thus adds structural stability to the resistor grid element and prevents warpage of the element upon heating.

The unique design of this element eliminates the number of frame members required for a high capacity resistor. This has the added advantage of reducing the weight of the assembly or alternatively adding additional elements to increase the capacity.

FIG. 6 is a sectional view of the resistor grid assembly. FIG. 6 depicts the frame member (12) through which the threaded rod (20) extends. The mica insulating sleeve (18) is clearly shown as are the coupled fiberglass insulating members (26 and 28).

Figure 7:
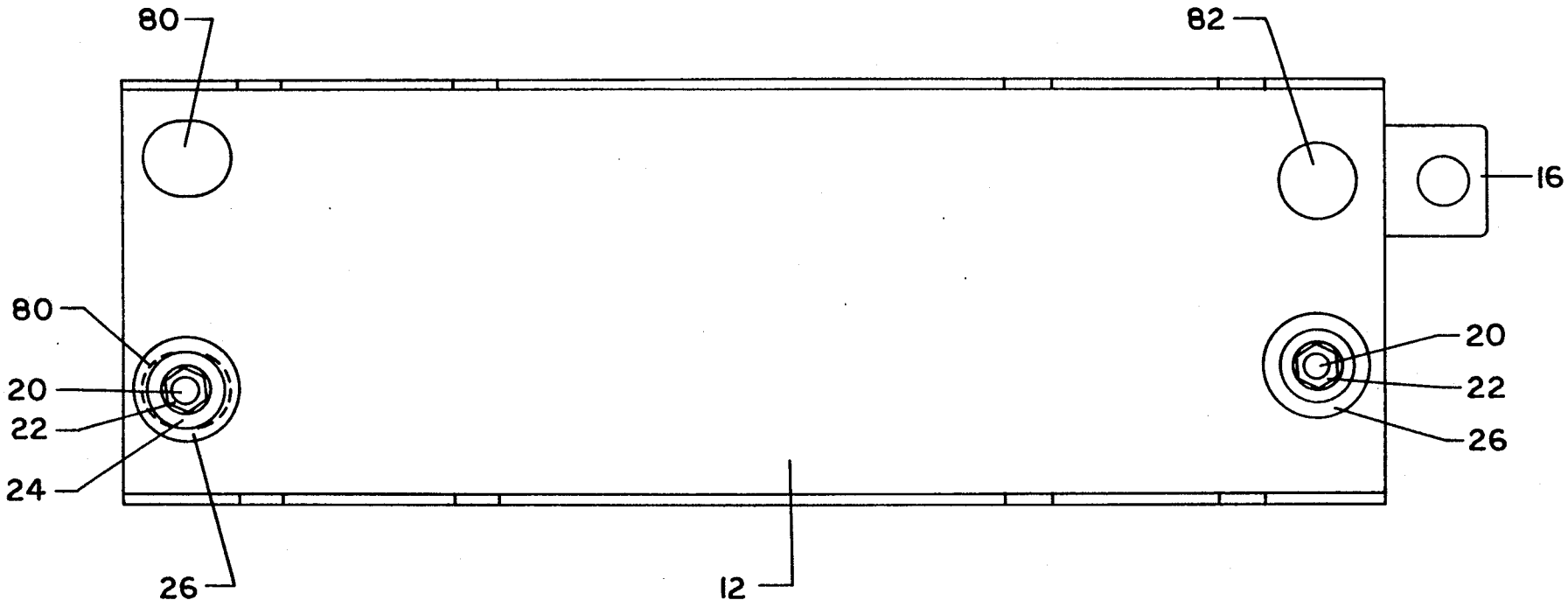
FIG. 7 is a side view of the frame or housing for the resistor grid assembly illustrating the floating support.

FIG. 7 is a side view of the end frame (12) showing the terminal (16) and the apertures (80, 82) for receiving the insulated rod (20). The design of the openings in the end frame provide a floating support system for the grid assembly that permits movement of the assembly upon expansion and contraction.

Apertures (80) at the non-terminal side of the end frame (12) are slotted to permit a pair of top rids (20) to float upon expansion and contraction when the grid assembly is subject to heating and cooling respectively. The apertures (80) which are slotted permit movement of the rods (20) within the slot while the apertures (82) are fitted to the rods (20) and do not permit movement of the rods (20). Apertures (82) at the terminal side of the housing are round and fitted to receive a pair of threaded rods (20) which are affixed to the end frame by means of the nut (22) and washer (24). A similar nut (22) and washer (24) is provided for securing the non-terminal side pair of rods to the end frame.

It will be readily apparent to those skilled in the art that the invention as described and illustrated in its preferred embodiments is not intended to be restrictive or limiting. Clearly, numerous additions, substitutions and other modifications can be made without departing from the scope of the invention as set forth in the appended claims.

We claim:

1. A high power resistor grid assembly comprising a rigid floating frame having two end plates and a set of fixed rods and a set of floating rods;

said frame having a terminal mounted on a fixed rod therein on a terminal side;

said frame having a non-terminal side of said frame opposing said terminal side;

said end plates having a first set of apertures at the terminal side of said frame and a second set of apertures at the non-terminal side of said frame;

said first set of apertures adapted to receive said fixed rods;

said second set of apertures adapted to receive said floating rods and permit movement of said rods within said second set of apertures;

a plurality of resistor grid elements mounted on said fixed and floating rods in substantially parallel arrangement welded together to form a continuous current path, at least one of said resistor grid elements in communication with said terminal;

a means for insulating said rods from said elements;

a means for insulating said frame from said elements;

and a means for uniformly spacing elements on said rods.

2. A high power resistor grid assembly as set forth in claim 1 wherein said second set of apertures adapted for receiving said floating rods at said non-terminal side of said frame comprises a pair of slotted openings.

3. A high power resistor grid assembly as set forth in claim 2 wherein said means for insulating said rod from said elements comprises a mica sleeve along with a mica washer positioned between steel washers on both sides of the said mica washer.

4. A high power resistor grid assembly as set forth in claim 3 wherein said resistor grid element comprises a slotted rectangular U-shaped element having a straight leg and an offset leg;

means located at the top of said element for mounting said element on a pair of rods;

said straight leg and said offset leg each having an embossment extending the width of said leg and extending longitudinally to tips of said leg;

said offset leg having a slotted means to receive a rod for affixing to said frame;

said straight leg having a means to receive a rod for affixing to said frame.

5. A high power resistor grid assembly s set forth in claim 4 wherein said element is of sheet metal composition of an unbreakable alloy.

6. A high power resistor grid element comprising a slotted rectangular U-shaped grid element having a straight leg and offset leg and an end joining said legs;

a means located at the top of said element for mounting said element on a rod;

said straight leg and said offset leg each having an embossment extending the width of said leg and extending longitudinally to an end of said leg;

said offset leg having a slotted means to receive a rod for affixing to a frame;

said straight leg having a means to receive a rod for affixing to a frame.

7. A high power resistor grid element as set forth in claim 6 wherein said element is of sheet metal composition of an unbreakable alloy.

* * * * *

UNITED STATES PATENT AND TRADEMARK OFFICE

CERTIFICATE OF CORRECTION

PATENT NO. : 6,157,373
DATED : December 5, 2000
INVENTOR(S) : Rego

It is certified that error appears in the above-identified patent and that said Letters Patent is hereby corrected as shown below:

Column 4,
Line 16, delete "trnnsmissive" and insert -- transmissive --.

Column 6,
Line 34, delete "interest. 25" and insert -- interest. --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*